US006080245A

United States Patent [19]

Uchida et al.

[11] Patent Number: 6,080,245

[45] Date of Patent: Jun. 27, 2000

[54] RARE EARTH PERMANENT MAGNET AND METHOD FOR PRODUCING THE SAME

[75] Inventors: Kimio Uchida, Saitama-ken; Masahiro Takahashi; Fumitake Taniguchi, both of Kumagaya, all of Japan

[73] Assignee: Hitachi Metals, Ltd., Tokyo, Japan

[21] Appl. No.: 09/165,348

[22] Filed: Oct. 2, 1998

Related U.S. Application Data

[62] Division of application No. 08/859,911, May 21, 1997, which is a division of application No. 08/642,856, May 6, 1996, Pat. No. 5,858,123.

[30] Foreign Application Priority Data

Jul. 12, 1995 [JP] Japan ..... 7-175952
Mar. 19, 1996 [JP] Japan ..... 8-90400

[51] Int. Cl.[7] ..... H01F 1/057

[52] U.S. Cl. ..... 148/103; 148/104

[58] Field of Search ..... 148/101, 102, 148/103, 104

[56] References Cited

U.S. PATENT DOCUMENTS 4,533,408 8/1985 Koon ..... 148/103
4,990,307 2/1991 Camp ..... 419/30
5,162,064 11/1992 Kim et al. ..... 148/302
5,314,548 5/1994 Panchanathan et al. ..... 148/101
5,405,455 4/1995 Kunsunoki et al. ..... 148/103
5,431,747 7/1995 Takebuchi et al. ..... 148/302
5,489,343 2/1996 Uchida et al. ..... 148/103

FOREIGN PATENT DOCUMENTS 0 633 581 1/1995 European Pat. Off. .
62-177147 4/1987 Japan .
4107903 4/1992 Japan .
6322469 11/1994 Japan .

*Primary Examiner*—John Sheehan
*Attorney, Agent, or Firm*—Finnegan, Henderson, Farabow, Garrett & Dunner

[57] ABSTRACT

A rare earth permanent magnet consisting essentially, by weight, of 27.0–31.0 % of at least one rare earth element including Y, 0.5–2.0 % of B, 0.02–0.15 % of N, 0.25 % or less of O, 0.15 % or less of C, at least one optional element selected from the group consisting of 0.1–2.0 % of Nb, 0.02–2.0 % of Al, 0.3–5.0 % of Co, 0.01–0.5 % of Ga and 0.01–1.0 % of Cu, and a balance of Fe, and a production method thereof. The contents of rare earth element, oxygen, carbon and oxygen in the magnet are regulated within the specific ranges.

4 Claims, 2 Drawing Sheets

RARE EARTH PERMANENT MAGNET AND METHOD FOR PRODUCING THE SAME

This is a division of application Ser. No. 08/859,911, filed May 21, 1997, which is a division of application Ser. No. 08/642,856, filed May 6,1996 now U.S. Pat. No. 5,858, 123. The contents of these applications being relied upon and expressly incorporated herein by reference.

BACKGROUND OF THE INVENTION

The present invention relates to an R—Fe—B-based rare earth permanent magnet, wherein R is one or more of rare earth elements including Y (yttrium), and a production method thereof.

A rare earth permanent magnet, in particular, an R—Fe—B-based, sintered permanent magnet has been applied to a wide variety of fields due to a high performance thereof.

The R—Fe—B-based, sintered permanent magnet has a metal structure basically composed of three phases of $R_2Fe_{14}B$ phase (main phase), $RFe_7B_6$ phase (B-rich phase) and $R_{85}Fe_{15}$ phase (R-rich phase). Generally, the R—Fe—B-based, sintered permanent magnet is inferior to an Sm—Co-based, sintered permanent magnet in corrosion resistance because of the presence of a rare earth element-rich phase and the three-phase metal structure. The poor corrosion resistance has been one of the drawbacks of the known R—Fe—B-based, sintered permanent magnet from the time of development to now.

Although the corrosion mechanism of the R—Fe—B-based, sintered permanent magnet has not been established, some report says that the corrosion proceeds with anodization of R-rich phase because the corrosion generally starts from R-rich phase. In fact, the amount of R-rich phase is reduced with decreasing content of rare earth element, and as a result thereof, the corrosion resistance of the R—Fe—B-based, sintered permanent magnet is improved. Therefore, one method for improving the corrosion resistance is to reduce the content of rare earth element.

A sintered rare earth magnet may be typically produced by a powder metallurgical method, for example, by melting and casting alloy metals for the magnet to form an alloy ingot, pulverizing the ingot to alloy powder, compacting the alloy powder to form a green body, sintering the compact body, heat-treating the sintered body and then working it. Since the alloy powder obtained by pulverizing an ingot has a high chemical activity because of a high content of rare earth element, the rare earth element is oxidized upon exposure to the atmosphere to result in increased oxygen content in the alloy powder. Therefore, a part of rare earth element is consumed to form a rare earth oxide to give a sintered body having a reduced content of magnetic rare earth element which contributes to magnetic properties of the sintered magnet. To compensate for the consumption of rare earth element and attain a practically sufficient level of magnetic properties, for example, a coercive force (iHc) of 13 kOe or higher, the content of rare earth element in the R—Fe—B-based, sintered permanent magnet is necessary to be increased. Practically, the rare earth element is added in an amount exceeding 31 weight %.

As mentioned above, the addition amount of the rare earth element should be decreased in view of improving the corrosion resistance, while be increased in view of attaining practically sufficient magnetic properties. Due to this antinomic requirement, a rare earth permanent magnet simultaneously having both a sufficient corrosion resistance and sufficient magnetic properties has not been obtained.

OBJECT AND SUMMARY OF THE INVENTION

Accordingly, an object of the present invention is to provide a R—Fe—B-based, sintered permanent magnet having a remarkably improved corrosion resistance and excellent magnetic properties.

As a result of the intense research in view of the above object, the inventors have found that a rare earth permanent magnet excellent in both the corrosion resistance and magnetic properties can be obtained by regulating the content of each of the rare earth element, oxygen, carbon and nitrogen within a respective specific range. The present invention has been accomplished based on this finding.

Thus, in a first aspect of the present invention, there is provided a rare earth permanent magnet consisting essentially, by weight, of 27.0–31.0% of at least one rare earth element including Y, 0.5–2.0% of B, 0.02–0.15% of N, 0.25% or less of O, 0.15% or less of C, at least one optional element selected from the group consisting of 0.1–2.0% of Nb, 0.02–2.0% of Al, 0.3–5.0% of Co, 0.01–0.5% of Ga and 0.01–1.0% of Cu, and a balance of Fe.

A second aspect of the present invention, there is provided a method for producing a rare earth permanent magnet, which comprises the steps of (a) finely pulverizing in a mill a coarse powder of an R—Fe—B-based alloy, wherein R is at least one rare earth element including yttrium, in nitrogen gas atmosphere containing substantially 0% of oxygen or in argon gas atmosphere containing substantially 0% of oxygen and 0.0001–0.1 volume % of nitrogen under a pressure of 5–10 kgf/cm$^2$ while feeding the coarse powder into the mill at a feeding rate of 3–20 kg/hr; (b) recovering the fine powder into a solvent in nitrogen gas atmosphere or argon gas atmosphere in the form of a slurry; (c) wet-compacting the slurry to form a green body while applying magnetic field; (d) heat-treating the green body in a vacuum furnace to remove the solvent therefrom; and (e) sintering the heat-treated green body in the vacuum furnace.

A third aspect of the present invention, there is provided a method for producing a rare earth permanent magnet, comprising the steps of (a) strip-casting a melt of an R—Fe—B-based alloy, wherein R is at least one rare earth element including yttrium, into an alloy strip having 1 mm or less; (b) heat-treating the alloy strip at 800–1100° C. in an inert gas atmosphere or in vacuo; (c) pulverizing the heat-treated alloy strip into a coarse powder; (d) pulverizing the coarse powder into a fine powder; (e) recovering the fine powder into a solvent in an inert gas atmosphere in the form of a slurry; (f) wet-compacting the slurry to form a green body while applying magnetic field; (g) heat-treating the green body in a vacuum furnace to remove the solvent therefrom; and (h) sintering the heat-treated green body in the vacuum furnace.

A fourth aspect of the present invention, there is provided a method for producing a rare earth permanent magnet, comprising the steps of (a) mixing a coarse powder of a first alloy mainly composed of $R_2Fe_{14}B$ phase, wherein R is at least one rare earth element including yttrium, and a coarse powder of a second alloy in a weight ratio of 70–99:1–30, the first alloy having a chemical composition, by weight, of 26.7–32% of R, 0.9–2.0% of B, 0.1–3.0% of M wherein M is at least one of Ga, Al and Cu and balance of Fe, and the second alloy having a chemical composition, by weight, of 35–70% of R, 5–50% of Co, 0.1–3.0% of M and balance of Fe; (b) pulverizing the mixture of the coarse powders into a fine powder; (c) recovering the fine powder into a solvent in an inert gas atmosphere in the form of a slurry; (d) wet-compacting the slurry to form a green body while applying magnetic field; and (e) sintering the heat-treated green body in the vacuum furnace.

DETAILED DESCRIPTION OF THE INVENTION

Figure 1:
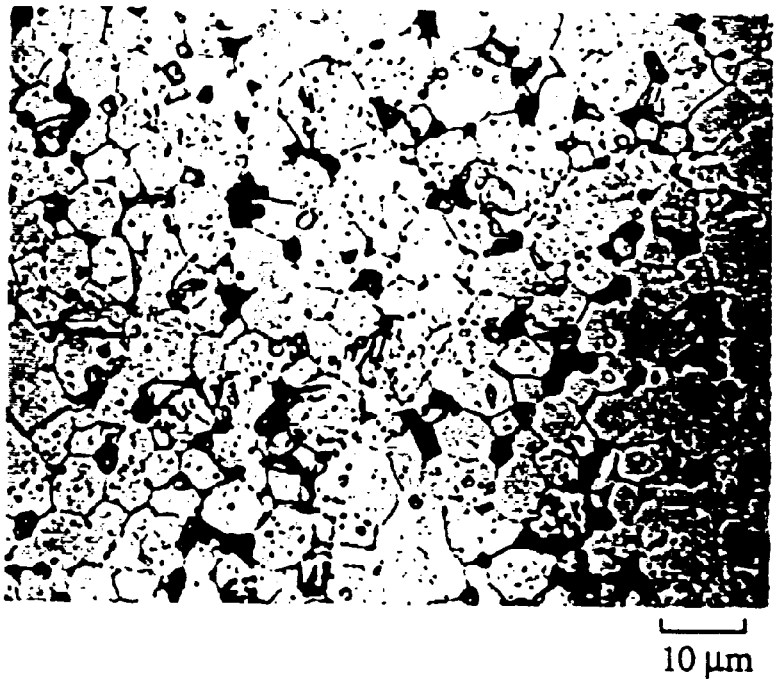
FIG. 1 is a microphotograph showing the metal structure of a rare earth permanent magnet having a main phase in which the total area of crystal grains having a grain size of 10 μm or less is 96% and the total area of crystal grains having a grain size of 13 μm or more is 1%, each based on the total area of crystal grains in said main phase.

First, the content of each element in the rare earth permanent magnet of the present invention will be described below.

The rare earth element referred to in the present invention is at least one element selected from the group consisting of lanthanides and yttrium. The content of the rare earth element is 27.0–31.0 weight % based on the total weight of the rare earth permanent magnet. When the content exceeds 31.0 weight %, the amount and the size of the R-rich phase in the sintered magnet become unfavorably larger to reduce the corrosion resistance. On the other hand, when the content is less than 27.0 weight %, a dense sintered magnet is not obtained because insufficient amount of the liquid phase, which is required for densification, during sintering operation. As a result thereof, the magnetic properties, in particular the residual magnetic flux density (Br) and coercive force (iHc), are decreased.

A preferred rare earth element may include Nd, Pr and Dy. Pr may be preferably contained in the rare earth permanent magnet in an amount of 0.1–10 weight %, and Dy in an amount of 0.5–15 weight %. Since Dy improves coercive force (iHc), it is further preferable for Dy to be contained in an amount of 0.8–10 weight %.

The content of oxygen is 0.05–0.25 weight %, preferably 0.2 weight % or less based on the total weight of the rare earth permanent magnet. When the content is larger than 0.25 weight %, since a part of the rare earth element is converted to oxides to reduce the amount of the rare earth element which directly contributes to the magnetic properties of magnet, the coercive force (iHc) is lowered. Since an alloy ingot from which an alloy powder to be sintered is produced inevitably contains 0.04 weight % of oxygen, the oxygen content in the final sintered magnet is practically difficult to be reduced to a level lower than 0.05 weight %.

The content of carbon is 0.01–0.15 weight %, 0.12 weight % or less, more preferably 0.10 weight % or less based on the total weight of the rare earth permanent magnet. When the content is higher than 0.15 weight %, since a part of the rare earth element is consumed to form carbides to reduce the amount of the rare earth element which directly contributes to the magnetic properties of magnet, the coercive force (iHc) is lowered. Since an alloy ingot from which an alloy powder to be sintered is produced inevitably contains 0.008 weight % of carbon, the carbon content in the final sintered magnet is practically difficult to be reduced to a level lower than 0.01 weight %.

From the inventor's studies, it has been found that the content of nitrogen should be strictly controlled in addition to regulating the content of rare earth element within 27.0–31.0 weight % to improve the corrosion resistance of the R—Fe—B-based, sintered permanent magnet. An excellent corrosion resistance and high magnetic properties can be simultaneously attained by controlling the nitrogen content to 0.02–0.15 weight %, preferably 0.03–0.13 weight % based on the total weight of the R—Fe—B-based, sintered permanent magnet along with controlling the contents of the rare earth element, oxygen and carbon to the respective ranges mentioned above. The mechanism of improving the corrosion resistance by the presence of 0.02–0.15 weight % of nitrogen has not yet been well known. It has been confirmed that the nitrogen in the R—Fe—B-based, sintered permanent magnet is mainly present in R-rich phase in the form of rare earth nitride. Therefore, it is presumed that inhibition of anodization of R-rich phase by the rare earth nitrides is responsible for improving the corrosion resistance. A nitrogen content less than 0.02 weight % exhibits no appreciable improvement, probably due to lack of formation amount of the rare earth nitrides. When the content is 0.02 weight % or higher, the corrosion resistance is improved more effectively with increasing nitrogen content. However, when the content exceeds 0.15 weight %, the coercive force (iHc) abruptly falls. This is presumed to be due to reduction of the amount of rare earth element by the formation of rare earth nitrides.

The rare earth permanent magnet of the present invention may further contain one or more of niobium (Nb), aluminum (Al), cobalt (Co), gallium (Ga) and copper (Cu).

Nb is converted to Nb borides during the sintering step, which prevent the anomalous growth of grains. The content of Nb is 0.1–2.0 weight %, preferably 0.2–1.5 weight % based on the total weight of the R—Fe—B-based, sintered permanent magnet. A content less than 0.1 weight % is insufficient for effectively preventing the anomalous growth of grains, and a content exceeding 2.0 weight % is undesirable because the residual magnetic flux density (Br) decreases due to increased amount of Nb borides.

Al is effective for increasing the coercive force (iHc), and may be contained in an amount of 0.02–2.0 weight %, preferably 0.04–1.8 weight % based on the total weight of the R—Fe—B-based, sintered permanent magnet. A content of less than 0.02 weight % is not effective for improving the coercive force (iHc). When the content exceeds 2.0 weight %, the residual magnetic flux density (Br) abruptly falls.

Co raises the Curie point, i.e., raises the temperature coefficient of saturation magnetization, and may be contained in an amount of 0.3–5.0 weight %, preferably 0.5–4.5 weight % based on the total weight of the R—Fe—B-based, sintered permanent magnet. A content less than 0.3 weight % is insufficient for raising the temperature coefficient, and when the content exceeds 5.0 weight %, both the residual magnetic flux density (Br) and the coercive force (iHc) abruptly decrease. The corrosion resistance and heat stability of the rare earth permanent magnet are increased with increasing amount of Co, while the residual magnetic flux density (Br) and the coercive force (iHc) are decreased. Therefore, the content of Co is more preferably 2.5 weight % or less, particularly preferably 2.0 weight % or less when high magnetic properties are desired. Since, in the present invention, the corrosion resistance is improved also by the uniform and fine grain structure as will be described below, a sufficiently good corrosion resistance may be attained even when the content of Co is 2.5 weight % or less.

Ga is effective for increasing the coercive force (iHc), and may be contained in an amount of 0.01–0.5 weight %, preferably 0.03–0.4 weight % based on the total weight of the R—Fe—B-based, sintered permanent magnet. A content of less than 0.01 weight % exhibits no improvement in coercive force (iHc). When the content exceeds 0.5 weight %, both the residual magnetic flux density (Br) and the coercive force (iHC) decrease.

Cu is also effective for increasing the coercive force (iHc), and may be contained in an amount of 0.01–1.0 weight %, preferably 0.01–0.8 weight % based on the total weight of the R—Fe—B-based, sintered permanent magnet. A content of less than 0.01 weight % exhibits no improvement in coercive force (iHc). A content exceeding 1.0 weight % exhibits no additional improvement.

In the present invention, the corrosion resistance and magnetic properties of the rare earth permanent magnet has been improved by regulating the contents of the rare earth elements, oxygen, carbon and nitrogen within the respective specific ranges. In addition, the corrosion resistance has been further improved by rendering the metal structure of rare earth permanent magnet uniformly fine. The "uniformly fine metal structure" referred to herein means a metal structure having a main phase in which the total area of crystal grains of a grain size of 10 μm or less is 80% or more and the total area of crystal grains of a grain size of 13 μm or more is 10% or less, each based on the total area of crystal grains in said main phase.

Figure 2:
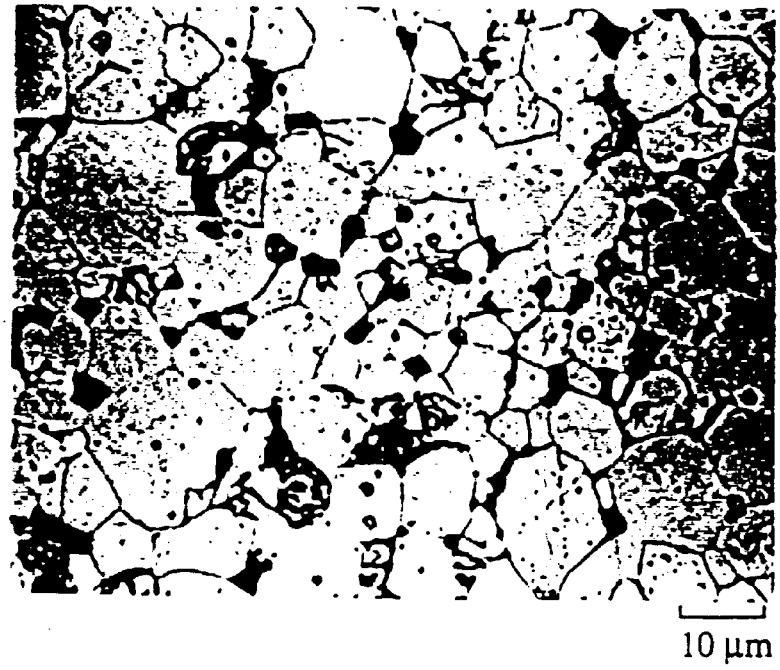
FIG. 2 is a microphotograph showing the metal structure of another rare earth permanent magnet having a main phase in which the total area of crystal grains having a grain size of 10 μm or less is 64% and the total area of crystal grains having a grain size of 13 μm or more is 17%, each based on the total area of crystal grains in said main phase.

FIG. 1 is a microphotograph showing the metal structure of a rare earth permanent magnet having a main phase in which the total area of crystal grains of a grain size of 10 μm or less is 96% and the total area of crystal grains of a grain size of 13 μm or more is 1%, each based on the total area of crystal grains in the main phase. FIG. 2 is a microphotograph showing the metal structure of a rare earth permanent magnet having a main phase in which the total area of crystal grains of a grain size of 10 μm or less is 64% and the total area of crystal grains of a grain size of 13 μm or more is 17%, each based on the total area of crystal grains in the main phase. Both the rare earth permanent magnets have the same alloying composition of 27.5 weight % of Nd, 0.5 weight % of Pr, 1.5 weight % of Dy, 1.1 weight % of B, 0.1 weight % of Al, 2.0 weight % of Co, 0.08 weight % of Ga, 0.16 weight % of O, 0.06 weight % of C, 0.040 weight % of N, and a balance of Fe.

The above area ratios were obtained by image-processing respective image (about×1000) of metal structure under a microscope (VANOX, trade name, manufactured by Olympus Optical Company Limited) by using an image-processing apparatus (LUZEX II, trade name, manufactured by Nireco, Ltd.).

To evaluate the corrosion resistance of the rare earth permanent magnets of FIGS. 1 and 2, the surface of each test sample (8 mm×8 mm×2 mm) was plated with Ni to about 20 μm thick. The Ni-plated test samples were allowed to stand in air under the condition of 2 atm., 120° C. and 100% relative humidity to observe the degree of exfoliation of the Ni-plating that occurred with the passage of time. In the rare earth permanent magnet having a uniformly fine grain structure as shown in FIG. 1, no abnormality or change was observed in the Ni-plating even after the passage of 2500 hours. On the other hand, in the rare earth permanent magnet having a coarser grain size as shown in FIG. 2, a significant exfoliation of the Ni-plating was observed after the passage of 2000 hours although no exfoliation after the passage of 1000 hours. Since the above corrosion test was conducted in accelerated manner, both the rare earth permanent magnets may be put into practical use without any problems in their corrosion resistance. However, the results of the above test clearly demonstrate that the corrosion resistance is further improved by the uniform and fine grain structure as defined above.

Figure 3:
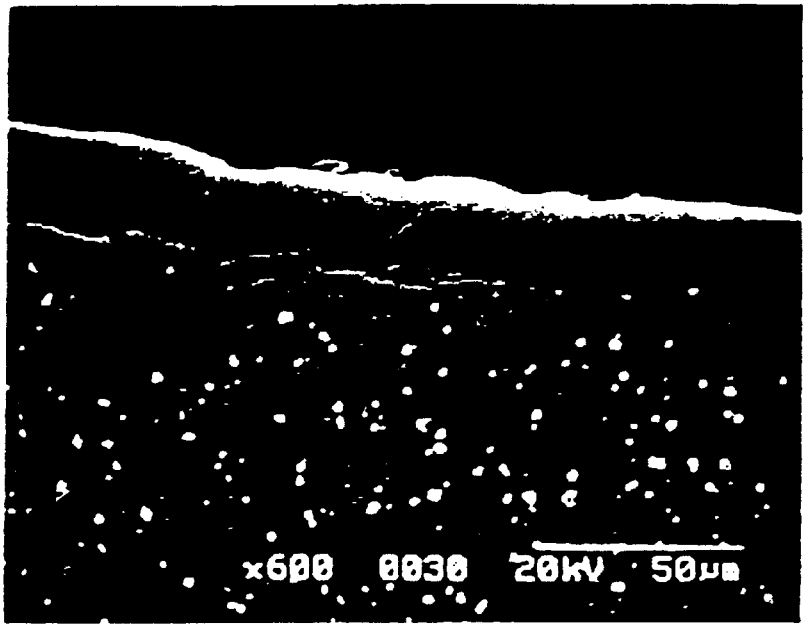
FIG. 3 is a scanning electron microphotograph showing the cross sectional view of the rare earth permanent magnet shown in FIG. 1 after the passage of 5000 hours in corrosion test.
Figure 4:
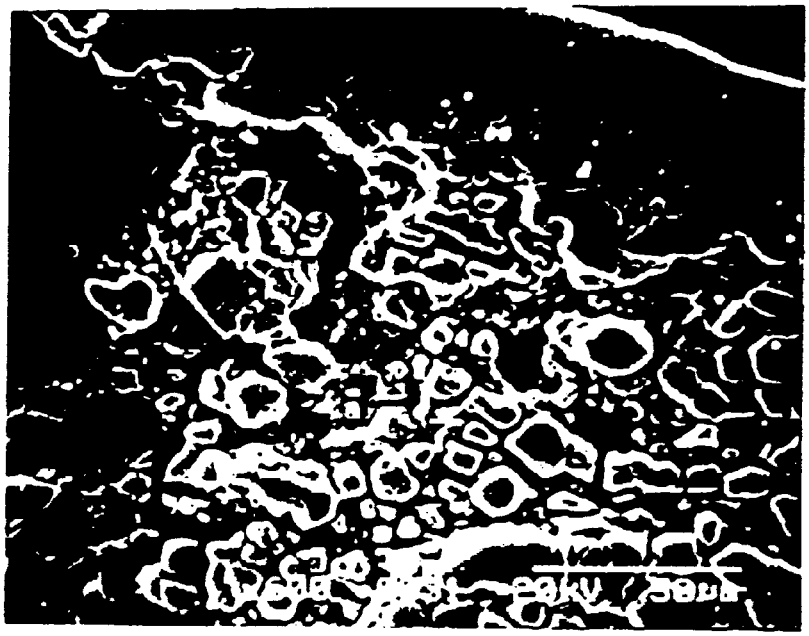
FIG. 4 is a scanning electron microphotograph showing the cross sectional view of the rare earth permanent magnet shown in FIG. 2 after the passage of 2000 hours in corrosion test.

FIG. 3 is a scanning electron microphotograph showing the cross sectional view of the rare earth permanent magnet shown in FIG. 1 after the passage of 5000 hours of the corrosion test. FIG. 4 is a scanning electron microphotograph showing the cross sectional view of the rare earth permanent magnet shown in FIG. 2 after the passage of 2000 hours of the corrosion test. In FIG. 3, although a slight exfoliation of the Ni-plating from the substrate (permanent magnet) occurs partially, the bonding between the Ni-plating and the substrate is good in view of practical use. Further, it can be seen that the metal structure of the rare earth permanent magnet is scarcely fractured by the corrosion test. In FIG. 4 having a coarse grain structure, it can be seen that a large exfoliation of the Ni-plating occurs due to the intergranular fracture in the metal structure of the substrate. From the results above, it has been found that the intergranular fracture by the accelerated corrosion test largely depends on the size of the grains in the main phase of permanent magnet.

The intergranular fracture of coarse grain structure is presumed to occur as follows. In the main phase having a relatively coarse grain structure as shown in FIG. 2, the intergranular space, mainly a grain boundary triple point, is occupied with an increased amount of the Nd-rich phase which is extremely susceptible to be oxidized. The factor responsible for corrosion fracture, for example, moisture in the above accelerated corrosion test, penetrates into the magnet intergranularly to cause the oxidation of the Nd-rich phase. Such oxidation of the Nd-rich phase may be considered to cause the chain intergranular fracture.

As described above, the corrosion resistance of the R—Fe—B-based, sintered permanent magnet can be further improved by the uniform and fine grain structure of the main phase defined as a main phase in which the total area of crystal grains of a grain size of 10 μm or less is 80% or more and the total area of crystal grains of a grain size of 13 μm or more is 10% or less, each based on the total area of crystal grains in said main phase.

The R—Fe—B-based, sintered permanent magnet of the present invention may be produced by the method described below.

Although the R—Fe—B-based starting coarse powder may be obtained by pulverizing an alloy ingot, a coarse powder obtained by pulverizing an alloy strip produced by a strip-casting method is preferable. The "strip-casting method" referred to in the present invention is a production method of alloy strip by injecting an alloy melt onto the surface of a cooling roll, etc. to quench the melt alloy, thereby forming alloy strip on the surface. It is important for obtaining a rare earth permanent magnet having a fine and uniform metal structure to sinter a fine powder having a uniform metal structure and a narrow particle size distribution. To obtain such a fine powder having an average particle size of 1–8 μm, preferably 3–5 μm, it is preferred to heat-treat an alloy ingot or an alloy strip, coarsely pulverize the heat-treated alloy ingot or alloy strip to coarse powder, and then finely pulverize the coarse powder.

Since an R—Fe—B-based alloy ingot usually includes in the alloy structure a precipitated α-Fe phase, the alloy ingot should be subjected to solution heat-treatment, prior to being pulverized, at 1000–1200° C. for 1–10 hours in an inert gas atmosphere or in vacuo to dissipate the α-Fe phase.

An alloy strip produced by rapidly quenching an alloy melt on a cooling surface in accordance with the strip-casting method has a fine metal structure. However, a fine powder having a narrow particle size distribution is not obtained by simply pulverizing the alloy strip due to the hard surface of the alloy strip which is formed during the strip-casting by rapid quenching of molten metal on a cooling roll. The inventors have found that the alloy strip can be pulverized to a fine powder having a narrow particle size distribution when subjected to heat treatment at 800–1100° C., preferably 950–1050° C. for 10 minutes to 10 hours in an inert gas atmosphere or in vacuum prior to being pulverized.

Although a mechanical pulverization may be employed in the present invention, the coarse pulverization is preferred to be carried out by spontaneously degrading the heat-treated alloy ingot or alloy strip by hydrogen occlusion thereinto, and dehydrogenating. The hydrogen occlusion is carried out by keeping the alloy strips in a furnace filled with hydrogen gas under a pressure of 1 atm. or less at normal temperature for until the alloy strips is sufficiently degraded. The occluded hydrogen embrittles the R-rich phase of the alloy strip to make the alloy strip easily degraded to a coarse powder of a narrow particle size distribution. Then, the furnace is evacuated and heated to 150–550° C., (and the degraded strips are held there for 30 minutes to 10 hours to complete the dehydrogenation. After the coarse pulverization by hydrogen-occlusion, the coarse powder may be further coarsely pulverized mechanically in the known manner. The coarse powder thus obtained preferably has a particle size of 32 mesh or less.

The starting coarse powder is obtained as described above. Further, the starting coarse powder may be a mixture of a coarse powder of first alloy and a coarse powder of second alloy, both the coarse powder being produced by heat-treating an alloy strip obtained by a strip-casting method and coarsely pulverizing the heat-treated alloy strip by hydrogen-occlusion as described above. The first alloy is mainly composed of $R_2Fe_{14}B$ phase (main phase) and has an alloy composition of 26.7–31 weight % of R, wherein R is one or more rare earth elements including Y, 0.9–2.0 weight % of B, 0.1–3.0 weight % of M, wherein M is one or more elements of Ga, Al and Cu, and balance of Fe. The second alloy has an alloy composition of 35–70 weight % of R, 5–50 weight % of Co, 0.1–3.0 weight % of M, and balance of Fe. The mixing ratio of the coarse powder of first alloy and the coarse powder of second alloy is 70–99:1–30 by weight. Also, these coarse powders should be mixed so that the final sintered permanent magnet has the alloy composition, by weight, of 27.0–31.0% of at least one rare earth element including Y, 0.5–2.0% of B, 0.02–0.15% of N, 0.05–0.25% of O, 0.01–0.15% of C, 0.3–5.0% of Co, at least one optional element selected from the group consisting of 0.02–2.0% of Al, 0.01–0.5% of Ga and 0.01–1.0% of Cu, and balance of Fe.

Next, the R—Fe—B-based coarse starting powder thus obtained is finely pulverized while adjusting the nitrogen content so that the nitrogen content in the final rare earth permanent magnet falls within the specific range of the present invention. For example, after introducing the R—Fe—B-based coarse starting powder into a pulverizer such as a jet mil, etc., the inner atmosphere is substituted with nitrogen gas to minimize the oxygen content in the nitrogen gas atmosphere to a level as low as substantially 0%. In this nitrogen gas atmosphere, the coarse powder is finely pulverized while feeding the coarse powder at a feeding rate of 3–20 kg/hr under a nitrogen gas pressure of 5–10 kgf/cm$^2$. The content of nitrogen in the starting powder is suitably adjusted by changing the introduced amount and the feeding rate so as to ensure the specific nitrogen content range of the present invention. Since the amount of nitrogen incorporated into the starting powder depends also on the type, size, etc., of a pulverizer, the introduced amount and the feeding rate are preferred to be tentatively determined prior to actual operation.

Alternatively, the nitrogen content in the starting powder may be suitably adjusted by introducing an amount of the R—Fe—B-based coarse powder into a pulverizer, replacing the inner atmosphere of the pulverizer with argon (Ar) gas to minimize the oxygen content in the Ar gas atmosphere to a level as low as substantially 0%, introducing nitrogen gas into the Ar gas atmosphere in such an amount that the $N_2$ content in the Ar gas atmosphere reaches, for example, 0.0001–0.1 vol. %, and then finely pulverizing the coarse powder in this atmosphere. During the pulverization, the nitrogen combines mainly with the rare earth element in the coarse powder to give a fine powder containing nitrogen in the predetermined amount.

In the present invention, the "substantially 0%" of the oxygen content means that the oxygen content by volume in the inner atmosphere of the pulverizer is preferably 0.01% or less, more preferably 0.005% or less, particularly preferably 0.002% or less.

The finely pulverized powder is recovered directly into a solvent in an inert gas atmosphere. The solvent may be selected from mineral oils, vegetable oils and synthetic oils, each having a flash point of 70° C. or higher and less than 200° C. at 1 atm., a fractionating point of 400° C. or less and a kinematic viscosity of 10 cSt or less at ordinary temperature. A slurry of the fine powder thus obtained is then wet-compacted in magnetic field to form a green body, preferably by a compression molding. The conditions for compression molding may be suitably selected depending on the practical operation parameter. Preferably, the compression molding is carried out under a molding pressure of 0.3–4.0 ton/cm$^2$ while applying an orientation magnetic field of 7 kOe or more, more preferably 10 kOe or more.

Then, the green body is heated to 100–300° C. in a vacuum furnace under a vacuum degree of $10^{-1}$–$10^{-3}$ Torr for a period sufficient for the full removal of the solvent in the green body to regulate the final carbon content within the range of 0.15 weight % or less based on the total weight of the rare earth permanent magnet. Next, the temperature of the vacuum furnace is raised to 1000–1200° C. and the green body is sintered at this temperature range for 30 minutes to 5 hours under a vacuum degree of $10^{-3}$–$10^{-6}$ Torr.

The sintered product thus obtained may be further subjected to annealing treatment, preferably tow-stage heat treatment by heated at 800–1000° C. for 1–3 hours and at 400–650° C. for 30 minutes to 3 hours in an inert gas atmosphere. Finally, the sintered product is machined, if necessary, to obtain a rare earth permanent magnet of the present invention.

The present invention will be further described while referring to the following Examples which should be considered to illustrate various preferred embodiments of the present invention.

EXAMPLE 1

A starting coarse powder of 32 mesh or less was prepared by pulverizing an alloy ingot having a chemical composition, by weight, of 24.0% of Nd, 3.0% of Pr, 2.0% of Dy, 1.1% of B, 1.3% of Nb, 1.0% of Al, 3.3% of Co, 0.1% of Ga, 0.01% of O, 0.005% of C, 0.007% of N and balance of Fe. The starting coarse powder thus prepared had a composition, by weight, of 23.9% of Nd, 2.9% of Pr, 2.0% of Dy, 1.1% of B, 1.2% of Nb, 1.0% of Al, 3.3% of Co, 0.1% of Ga, 0.14% of O, 0.02% of C, 0.007% of N and balance of Fe.

After 50 kg of the starting coarse powder was introduced into a jet mill, the inner atmosphere of the jet mill was replaced with Ar gas while controlling the oxygen content in the Ar gas atmosphere to substantially zero %. The nitrogen content in the Ar gas atmosphere was adjusted to 0.003 vol. % by introducing $N_2$ gas into the Ar gas atmosphere. Then, the coarse powder was finely pulverized under a pressure of 7.5 kgf/cm$^2$ while feeding the coarse powder into the jet mill at a rate of 8 kg/hr.

After completion of fine pulverization, the fine powder was recovered from the jet mill directly into a mineral oil (Idemitsu Super Sol PA-30, trade name, manufactured by Idemitsu Kosan Co., Ltd.) in the Ar gas atmosphere. The recovered fine powder was made into a slurry having a solid content of 75 weight % by adjusting the amount of the mineral oil. The average particle size of the fine powder was 4.7 $\mu$m.

The slurry was then subjected to wet-compacting in a mold cavity while applying an orientation magnetic field of 14 kOe and a molding pressure of 1.0 ton/cm$^2$. The orientation magnetic field and the molding pressure were applied in the directions perpendicular to each other to form a green body. During the wet-compacting, a portion of mineral oil was discharged from a plurality of holes of the upper punch equipped with the mold cavity through a cloth filter of 1 mm thick.

The green body thus formed was heated in a vacuum furnace at 200° C. for one hour under a vacuum degree of $3.0\times10^{-2}$ Torr to remove the residual mineral oil. Then the temperature of the vacuum furnace was raised at a rate of 15° C./min to 1070° C. under a vacuum degree of $4.0\times10^{-4}$ Torr. The temperature was maintained at 1070° C. for 3 hours to complete the sintering of the green body, thereby obtaining a rare earth permanent magnet.

The rare earth permanent magnet was found to have a composition as shown in Table 1. The rare earth permanent magnet was further subjected to heat-treatment at 900° C. for 2 hours and at 530° C. for 1 hour, each in Ar gas atmosphere. Upon measuring the magnetic properties (residual magnetic flux density: Br; coercive force: iHc; and maximum energy product: (BH)max) after machining, the rare earth permanent magnet was found to have good magnetic properties as shown in Table 1.

To evaluate the corrosion resistance of the rare earth permanent magnet, the surface of a test sample of 8 mm×8 mm×2 mm obtained by machining the rare earth permanent magnet was plated with Ni into 10 $\mu$m thick. The Ni-plated test sample was allowed to stand in air under the conditions of 2 atm., 120° C. and 100% of relative humidity. The degree of exfoliation of the Ni-plating from the surface of the rare earth permanent magnet was observed. As shown in Table 1, the rare earth permanent magnet exhibited a good corrosion resistance because no change was observed in the Ni-plating even after the passage of 1000 hours.

EXAMPLE 2

The same starting coarse powder as used in Example 1 was finely pulverized in the same manner as in Example 1 except for adjusting the nitrogen content in the Ar gas atmosphere to 0.006 vol. % to obtain a slurry containing a fine powder having an average particle size of 4.8 $\mu$m. The slurry was further subjected to the same procedure as in Example 1 to obtain a rare earth permanent magnet having a composition shown in Table 1.

The magnetic properties and the result of the same corrosion test as in Example 1 are shown in Table 1. As seen from Table 1, the rare earth permanent magnet had good magnetic properties and no change in the Ni-plating was observed even after the passage of 1200 hours.

EXAMPLE 3

The same starting coarse powder as used in Example 1 was finely pulverized in the same manner as in Example 1 except for adjusting the nitrogen content in the Ar gas atmosphere to 0.015 vol. % to obtain a slurry containing a fine powder having an average particle size of 4.7 $\mu$m. The slurry was further subjected to the same procedure as in Example 1 to obtain a rare earth permanent magnet having a composition shown in Table 1.

The magnetic properties and the result of the same corrosion test as in Example 1 are shown in Table 1. As seen from Table 1, the rare earth permanent magnet had good magnetic properties and no change in the Ni-plating was observed even after the passage of 1500 hours.

Comparative Example 1

The same starting coarse powder as used in Example 1 was finely pulverized in the same manner as in Example 1 except for adjusting the nitrogen content in the Ar gas atmosphere to 0.00005 vol. % to obtain a slurry containing a fine powder having an average particle size of 4.7 $\mu$m. The slurry was further subjected to the same procedure as in Example 1 to obtain a rare earth permanent magnet having a composition shown in Table 1.

The magnetic properties and the result of the same corrosion test as in Example 1 are shown in Table 1. As seen from Table 1, although the rare earth permanent magnet had good magnetic properties, the corrosion resistance was extremely poor because the Ni-plating began to exfoliate after the passage of 120 hours.

Comparative Example 2

The same starting coarse powder as used in Example 1 was finely pulverized in the same manner as in Example 1 except for adjusting the nitrogen content in the Ar gas atmosphere to 0.13 vol. % to obtain a slurry containing a fine powder having an average particle size of 4.6 $\mu$m. The slurry was further subjected to the same procedure as in Example 1 to obtain a rare earth permanent magnet having a composition shown in Table 1.

The magnetic properties and the result of the same corrosion test as in Example 1 are shown in Table 1. As seen from Table 1, the rare earth permanent magnet showed a good corrosion resistance because no change in the Ni-plating was observed even after the passage of 1800 hours. However, the rare earth permanent magnet has poor magnetic properties, in particular, the coercive force (iHc) was too low to be put into practice.

Comparative Example 3

A starting coarse powder of 32 mesh or less was prepared by pulverizing an alloy ingot having an alloy composition, by weight, of 26.8% of Nd, 3.5% of Pr, 2.0% of Dy, 1.1% of B, 1.3% of Nb, 1.0% of Al, 3.3% of Co, 0.1% of Ga, 0.01% of O, 0.005% of C, 0.007% of N and balance of Fe. The starting coarse powder thus prepared had a composition, by weight, of 26.7% of Nd, 3.5% of Pr, 2.0% of Dy, 1.1% of B, 1.3% of Nb, 1.0% of Al, 3.3% of Co, 0.1% of Ga, 0.18% of O, 0.03% of C, 0.009% of N and balance of Fe.

The starting coarse powder was finely pulverized in the same manner as in Example 1 to obtain a slurry containing a fine powder having an average particle size of 4.5 $\mu$m. A rare earth permanent magnet was produced from the slurry in the same manner as in Example 1. The chemical composition of the rare earth permanent magnet is shown in Table 1.

The magnetic properties and the result of the same corrosion test as in Example 1 are shown in Table 1. As seen from Table 1, although the rare earth permanent magnet was good in magnetic properties, extremely poor in the corrosion resistance because the Ni-plating began to exfoliate only in 24 hours.

Comparative Example 4

The same starting coarse powder as used in Example 1 was finely pulverized in the same manner as in Example 1 except for adjusting the oxygen content and nitrogen content in the Ar gas atmosphere to 0.05 vol. % and 0.006 vol. %, respectively, to obtain a slurry containing a fine powder having an average particle size of 4.6 $\mu$m. The slurry was further subjected to the same procedure as in Example 1 to obtain a rare earth permanent magnet having a composition shown in Table 1.

The magnetic properties and the result of the same corrosion test as in Example 1 are shown in Table 1. As seen from Table 1, the rare earth permanent magnet showed a good corrosion resistance because no change in the Ni-plating was observed even after the passage of 1200 hours. However, the rare earth permanent magnet has poor magnetic properties, in particular, the coercive force (iHc) was too low to be put into practice.

Comparative Example 5

The same starting coarse powder as used in Example 1 was finely pulverized in the same manner as in Example 1 except for adjusting the nitrogen content in the Ar gas atmosphere to 0.007 vol. % to obtain a slurry containing a fine powder having an average particle size of 4.7 $\mu$m. A green body was formed from the slurry in the same manner as in Example 1.

Without being subjected to heating for removing the mineral oil, the green body was heated from room temperature to 1070° C. at a rate of 15° C./min and kept at 1070° C. for 3 hours under a vacuum degree of $5.0\times10^{-4}$ Torr to complete the sintering. The sintered product was heat-treated in the same manner as in Example 1 to obtain a rare earth permanent magnet having a chemical composition shown in Table 1.

The magnetic properties and the result of the same corrosion test as in Example 1 are shown in Table 1. As seen from Table 1, the rare earth permanent magnet showed a good corrosion resistance because no change in the Ni-plating was observed even after the passage of 1200 hours. However, the rare earth permanent magnet has poor magnetic properties, in particular, the coercive force (iHc) was too low to be put into practice.

Comparative Example 6

The same green body as obtained in Comparative Example 4 was sintered and heat-treated in the same manner as in Comparative Example 5 to obtain a rare earth permanent magnet having a chemical composition shown in Table 1.

The magnetic properties and the result of the same corrosion test as in Example 1 are shown in Table 1. As seen from Table 1, the rare earth permanent magnet showed a good corrosion resistance because no change in the Ni-plating was observed even after the passage of 1200 hours. However, the rare earth permanent magnet has poor magnetic properties, in particular, the coercive force (iHc) was too low to be put into practice.

TABLE 1

| | Chemical Composition of Magnet (weight %) | | | | | | | | | | | | |
|---|---|---|---|---|---|---|---|---|---|---|---|---|---|
| No. | Nd | Pr | Dy | B | Fe | Nb | Al | Co | Ga | Cu | N | O | C |
| | | | | | | Examples | | | | | | | |
| 1 | 23.9 | 2.9 | 2.0 | 1.1 | bal. | 1.2 | 1.0 | 3.3 | 0.1 | — | 0.03 | 0.17 | 0.06 |
| 2 | 23.9 | 2.9 | 2.0 | 1.1 | bal. | 1.2 | 1.0 | 3.3 | 0.1 | — | 0.05 | 0.16 | 0.06 |
| 3 | 23.9 | 2.9 | 2.0. | 1.1 | bal. | 1.2 | 1.0 | 3.3 | 0.1 | — | 0.12 | 0.16 | 0.06 |
| | | | | | | Comparative Examples | | | | | | | |
| 1 | 23.9 | 2.9 | 2.0 | 1.1 | bal. | 1.2 | 1.0 | 3.3 | 0.1 | — | 0.01 | 0.18 | 0.06 |
| 2 | 23.9 | 2.9 | 2.0 | 1.1 | bal. | 1.2 | 1.0 | 3.3 | 0.1 | — | 0.20 | 0.18 | 0.06 |
| 3 | 26.7 | 3.5 | 2.0 | 1.1 | bal. | 1.3 | 1.0 | 3.3 | 0.1 | — | 0.04 | 0.20 | 0.07 |
| 4 | 23.9 | 2.9 | 2.0 | 1.1 | bal. | 1.2 | 1.0 | 3.3 | 0.1 | — | 0.05 | 0.30 | 0.06 |
| 5 | 23.9 | 2.9 | 2.0 | 1.1 | bal. | 1.2 | 1.0 | 3.3 | 0.1 | — | 0.06 | 0.16 | 0.18 |
| 6 | 23.9 | 2.9 | 2.0 | 1.1 | bal. | 1.2 | 1.0 | 3.3 | 0.1 | — | 0.05 | 0.29 | 0.17 |

| | Magnetic Properties | | | |
|---|---|---|---|---|
| No. | Br (kG) | iHc (kOe) | (BH)max (MGOe) | Corrosion Resistance |

TABLE 1-continued

| | | | | |
|---|---|---|---|---|
| | | | Examples | |
| 1 | 13.7 | 14.5 | 45.5 | No change in Ni-plating after 1000 hrs. |
| 2 | 13.7 | 14.4 | 45.5 | No change in Ni-plating after 1200 hrs. |
| 3 | 13.7 | 14.2 | 45.5 | No change in Ni-plating after 1500 hrs. |
| | | | Comparative Examples | |
| 1 | 13.7 | 14.6 | 45.5 | Exfoliation of Ni-plating after 120 hrs. |
| 2 | 13.7 | 11.0 | 44.8 | No change in Ni-plating after 1800 hrs. |
| 3 | 13.0 | 17.0 | 40.5 | Exfoliation of Ni-plating after 24 hrs. |
| 4 | 13.7 | 10.5 | 44.1 | No change in Ni-plating after 1200 hrs. |
| 5 | 13.7 | 10.8 | 44.3 | No change in Ni-plating after 1200 hrs. |
| 6 | 13.7 | 7.5 | 42.5 | No change in Ni-plating after 1200 hrs. |

EXAMPLE 4

An alloy strips of 0.2–0.5 mm thick having a chemical composition, by weight, of 27.0% of Nd, 0.5% of Pr, 1.5% of Dy, 1.05% of B, 0.35% of Nb, 0.08% of Al, 2.5% of Co, 0.09% of Ga, 0.08% of Cu, 0.03% of O, 0.005% of C, 0.004% of N and balance of Fe were produced by a strip-casting method. After being heat-treated at 1000° C. for 2 hours in Ar gas atmosphere, the alloy strips were spontaneously degraded by hydrogen occlusion in a furnace at room temperature. Then, after evacuating the furnace, the dehydrogenation was effected by heating the alloy strips to 550° C. and keeping there for one hour.

The degraded strips were mechanically pulverized in a nitrogen gas atmosphere to obtain a starting coarse powder of 32 mesh or less having a chemical composition, by weight, of 27.0% of Nd, 0.5% of Pr, 1.5% of Dy, 1.05% of B, 0.35% of Nb, 0.08% of Al, 2.5% of Co, 0.09% of Ga, 0.08% of Cu, 0.12% of O, 0.02 of C, 0.008% of N and balance of Fe.

After 50 kg of the starting coarse powder was introduced into a jet mill, the inner atmosphere of the jet mill was replaced with $N_2$ gas while controlling the oxygen content in the $N_2$ gas atmosphere to substantially zero % (0.001 vol. % under an oxygen analyzer). Then, the coarse powder was finely pulverized under a pressure of 7.0 kgf/cm$^2$ while feeding the coarse powder into the jet mill at a rate of 10 kg/hr.

After completion of fine pulverization, the fine powder was recovered from the jet mill directly into a mineral oil (Idemitsu Super Sol PA-30, trade name, manufactured by Idemitsu Kosan Co., Ltd.) under $N_2$ gas atmosphere. The recovered fine powder was made into a slurry having a solid content of 80 weight % by adjusting the amount of the mineral oil. The average particle size of the fine powder was 3.9 $\mu$m.

The slurry was then subjected to wet-compacting in a mold cavity while applying an orientation magnetic field of 12 kOe and a molding pressure of 0.8 ton/cm$^2$. The orientation magnetic field and the molding pressure were applied in the directions perpendicular to each other to form a green body. During the wet-compacting, a portion of mineral oil was discharged from a plurality of holes of the upper punch equipped with the mold cavity through a cloth filter of 1 mm thick.

The green body thus formed was heated in a vacuum furnace at 200° C. for one hour under a vacuum degree of $5.0\times10^{-2}$ Torr to remove the residual mineral oil. Then the temperature of the vacuum furnace was raised at a rate of 15° C./min to 1070° C. under a vacuum degree of $4.0\times10^{-4}$Torr. The temperature was maintained at 1070° C. for 3 hours to complete the sintering of the green body, thereby obtaining a rare earth permanent magnet having a chemical composition as shown in Table 2.

The area ratios of grains in the main phase of the rare earth permanent magnet, i.e., the ratio of total area of crystal grains having a grain size of 10 $\mu$m or less and the ratio of total area of crystal grains having a grain size of 13 $\mu$m or more both based on the total area of crystal grains in the main phase, obtained as mentioned above are also shown in Table 2.

The rare earth permanent magnet was further subjected to heat-treatment at 900° C. for 2 hours and at 480° C. for 1 hour, each in Ar gas atmosphere. Upon measuring, the magnetic properties after machining, the rare earth permanent magnet was found to have good magnetic properties as shown in Table 2.

The corrosion resistance of the rare earth permanent magnet was evaluated in the same manner as in Example 1. As shown in Table 2, the rare earth permanent magnet exhibited a good corrosion resistance because no change was observed in the Ni-plating even after the passage of 2500 hours. As compared the results with those of Examples 8 and 9 described below, the rare earth permanent magnet obtained above showed excellent corrosion resistance. Therefore, it would be evident from the above comparison that the corrosion resistance can be further improved by the uniform and fine grain structure of the main phase, i.e., by regulating the ratio of grains having a grain size of 10 $\mu$m or less to 80% or more and the ratio of grains having a grain size of 13 $\mu$m or more to 10% or less.

EXAMPLE 5

An alloy strips of 0.2–0.4 mm thick having a chemical composition, by weight, of 22.3% of Nd, 2.0% of Pr, 5.5% of Dy, 1.0% of B, 0.5% of Nb, 0.2% of Al, 2.0% of Co, 0.09% of Ga, 0.1% of Cu, 0.02% of O, 0.005% of C, 0.003% of N and balance of Fe were produced by a strip-casting method. After being heat-treated at 1100° C. for 2 hours in Ar gas atmosphere, the alloy strips were subjected to the same hydrogen-occlusion, dehydrogenation and mechanical pulverization as in Example 4 to obtain a starting coarse powder of 32 mesh or less having a chemical composition, by weight, of 22.3 1% of Nd, 2.0% of Pr, 5.5% of Dy, 1.0% of B, 0.5% of Nb, 0.2% of Al, 2.0% of Co, 0.09% of Ga, 0.1% of Cu, 0.11% of O, 0.02% of C, 0.006% of N and balance of Fe.

After 100 kg of the starting coarse powder was introduced into a jet mill, the inner atmosphere of the jet mill was replaced with $N_2$ gas while controlling the oxygen content in the $N_2$ gas atmosphere to substantially zero % (0.002 vol. % under an oxygen analyzer). Then, the coarse powder was finely pulverized under a pressure of 8.0 kgf/cm$^2$ while feeding the coarse powder into the jet mill at a rate of 12 kg/hr.

After completion of fine pulverization, the fine powder was recovered from the jet mill directly into a mineral oil (Idemitsu Super Sol PA-30, trade name, manufactured by Idemitsu Kosan Co., Ltd.) under $N_2$ gas atmosphere. The recovered fine powder was made into a slurry having a solid content of 77 weight % by adjusting the amount of the mineral oil. The average particle size of the fine powder was 3.8 $\mu$m.

The slurry was then subjected to wet-compacting in a mold cavity while applying an orientation magnetic field of 10 kOe and a molding pressure of 1.5 ton/cm$^2$. The orientation magnetic field and the molding pressure were applied in the directions perpendicular to each other to form a green body. During the wet-compacting, a portion of mineral oil was discharged from a plurality of holes of the upper punch equipped with the mold cavity through a cloth filter of 1 mm thick.

The green body thus formed was heated in a vacuum furnace at 200° C. for 2 hours under a vacuum degree of $5.0\times10^{-2}$ Torr to remove the residual mineral oil. Then the temperature of the vacuum furnace was raised at a rate of 15° C./min to 1090° C. under a vacuum degree of $5.0\times10^{-4}$ Torr. The temperature was maintained at 1090° C. for 3 hours to complete the sintering of the green body, thereby obtaining a rare earth permanent magnet having a chemical composition as shown in Table 2.

The area ratios of grains in the main phase of the rare earth permanent magnet obtained in the same manner as in Example 4 are shown in Table 2.

The rare earth permanent magnet was further subjected to heat-treatment at 900° C. for 2 hours and at 460° C. for 1 hour, each in Ar gas atmosphere.

The magnetic properties and the result of the same corrosion test as in Example 1 are shown in Table 2. As seen from Table 2, the rare earth permanent magnet had good magnetic properties and no change in the Ni-plating was observed even after the passage of 2500 hours.

EXAMPLE 6

An alloy strips of 0.1–0.5 mm thick having a chemical composition, by weight, of 20.7% of Nd, 8.6% of Pr, 1.2% of Dy, 1.05% of B, 0.08% of Al, 2.0% of Co, 0.09% of Ga, 0.1% of Cu, 0.03% of O, 0.006% of C, 0.004% of N and balance of Fe were produced by a strip-casting method. After being heat-treated at 900° C. for 3 hours in Ar gas atmosphere, the alloy strips were subjected to the same hydrogen-occlusion, dehydrogenation and mechanical pulverization as in Example 4 to obtain a starting coarse powder of 32 mesh or less having a chemical composition, by weight, of 20.7% of Nd, 8.6% of Pr, 1.5% of Dy, 1.05% of B, 0.08% of Al, 2.0% of Co, 0.09% of Ga, 0.1% of Cu, 0.13% of O, 0.03% of C, 0.009% of N and balance of Fe.

After 50 kg of the starting coarse powder was introduced into a jet mill, the inner atmosphere of the jet mill was replaced with Ar gas while controlling the oxygen content in the Ar gas atmosphere to substantially zero % (0.002 vol. % under an oxygen analyzer). The nitrogen content in the Ar gas atmosphere was adjusted to 0.005 vol. % by introducing $N_2$ gas into the Ar gas atmosphere. Then, the coarse powder was finely pulverized under a pressure of 7.5 kgf/cm$^2$ while feeding the coarse powder into the jet mill at a rate of 8 kg/hr.

After completion of fine pulverization, the fine powder was recovered from the jet mill directly into a mineral oil (Idemitsu Super Sol PA-30, trade name, manufactured by Idemitsu Kosan Co., Ltd.) in the Ar gas atmosphere. The recovered fine powder was made into a slurry having a solid content of 75 weight % by adjusting the amount of the mineral oil. The average particle size of the fine powder was 4.0 $\mu$m.

The slurry was then subjected to wet-compacting in a mold cavity while applying an orientation magnetic field of 13 kOe and a molding pressure of 0.6 ton/cm$^2$. The orientation magnetic field and the molding pressure were applied in the directions perpendicular to each other to form a green body. During the wet-compacting, a portion of mineral oil was discharged from a plurality of holes of the upper punch equipped with the mold cavity through a cloth filter of 1 mm thick.

The green body thus formed was heated in a vacuum furnace at 180° C. for 4 hours under a vacuum degree of $6.0\times10^{-2}$ Torr to remove the residual mineral oil. Then the temperature of the vacuum furnace was raised at a rate of 15° C./min to 1070° C. under a vacuum degree of $3.0\times10^{-4}$ Torr. The temperature was maintained at 1070° C. for 2 hours to complete the sintering of the green body, thereby obtaining a rare earth permanent magnet having a chemical composition as shown in Table 2.

The area ratios of grains in the main phase of the rare earth permanent magnet obtained in the same manner as in Example 4 are shown in Table 2.

The rare earth permanent magnet was further subjected to heat-treatment at 900° C. for 2 hours and at 510° C. for 1 hour, each in Ar gas atmosphere.

The magnetic properties and the result of the same corrosion test as in Example 1 are shown in Table 2. As seen from Table 2, the rare earth permanent magnet had good magnetic properties and no change in the Ni-plating was observed even after the passage of 2500 hours.

EXAMPLE 7

An alloy strips of 0.1–0.4 mm thick having a chemical composition, by weight, of 22.0% of Nd, 5.0% of Pr, 1.5% of Dy, 1.1% of B, 1.0% of Al, 2.5% of Co, 0.02% of O, 0.005% of C, 0.005% of N and balance of Fe were produced by a strip-casting method. After being heat-treated at 1000° C. for 2 hours in Ar gas atmosphere, the alloy strips were coarsely pulverized mechanically in nitrogen gas atmosphere to obtain a starting coarse powder of 32 mesh or less having a chemical composition, by weight, of 22.0% of Nd, 5.0% of Pr, 1.5% of Dy, 1.1% of B, 1.1% of Al, 2.5% of Co, 0.1% of O, 0.01% of C, 0.009% of N and balance of Fe.

After 50 kg of the starting coarse powder was introduced into a jet mill, the inner atmosphere of the jet mill was replaced with $N_2$ gas while controlling the oxygen content in the $N_2$ gas atmosphere to substantially zero % (0.002 vol. % under an oxygen analyzer). Then, the coarse powder was finely pulverized under a pressure of 7.0 kgf/cm$^2$ while feeding the coarse powder into the jet mill at a rate of 10 kg/hr.

After completion of fine pulverization, the fine powder was recovered from the jet mill directly into a mineral oil (Idemitsu Super Sol PA-30, trade name, manufactured by Idemitsu Kosan Co., Ltd.) in $N_2$ gas atmosphere. The recovered fine powder was made into a slurry having a solid content of 78 weight % by adjusting the amount of the mineral oil. The average particle size of the fine powder was 4.2 $\mu$m.

The slurry was then subjected to wet-compacting in a mold cavity while applying an orientation magnetic field of 11 kOe and a molding pressure of 0.5 ton/cm$^2$. The orientation magnetic field and the molding pressure were applied in the directions perpendicular to each other to form a green body. During the wet-compacting, a portion of mineral oil was discharged from a plurality of holes of the upper punch equipped with the mold cavity through a cloth filter of 1 mm thick.

The green body thus formed was heated in a vacuum furnace at 180° C. for 2 hours under a vacuum degree of $5.0\times10^{-2}$ Torr to remove the residual mineral oil. Then the temperature of the vacuum furnace was raised at a rate of 15° C./min to 1080° C. under a vacuum degree of $2.0\times10^{-4}$Torr. The temperature was maintained at 1080° C. for 2 hours to complete the sintering of the green body, thereby obtaining a rare earth permanent magnet having a chemical composition as shown in Table 2.

The area ratios of grains in the main phase of the rare earth permanent magnet obtained in the same manner as in Example 4 are shown in Table 2.

The rare earth permanent magnet was further subjected to heat-treatment at 900° C. for 2 hours and at 600° C. for 1 hour, each in Ar gas atmosphere.

The magnetic properties and the result of the same corrosion test as in Example 1 are shown in Table 2. As seen from Table 2, the rare earth permanent magnet had good magnetic properties and no change in the Ni-plating was observed even after the passage of 2000 hours.

EXAMPLE 8

The same alloy strips as obtained in Example 4 were subjected to the same coarse pulverization procedure as in Example 4 except for eliminating the heat treatment to obtain a starting coarse powder of 32 mesh or less having a chemical composition, by weight, of 27.0% of Nd, 0.5% of Pr, 1.5% of Dy, 1.05% of B, 0.35% of Nb, 0.08% of Al, 2.5% of Co, 0.09% of Ga, 0.08% of Cu, 0.10% of O, 0.02% of C, 0.007% of N and balance of Fe.

A slurry containing the fine powder of an average particle size of 4.4 $\mu$m was prepared in the same manner as in Example 4 except that the starting coarse powder was finely pulverized in the same manner as in Example 1. The slurry was formed into a green body, sintered and heat-treated in the same manner as in Example 4 to produce a rare earth permanent magnet having a chemical composition as shown in Table 2.

The area ratios of grains in the main phase of the rare earth permanent magnet obtained in the same manner as in Example 4 are shown in Table 2.

Further, the magnetic properties and the result of the same corrosion test as in Example 1 are shown in Table 2. As seen from Table 2, the rare earth permanent magnet had magnetic properties (Br and iHc) slightly smaller than those of Example 4 and no change in the Ni-plating was observed even after the passage of 1200 hours.

EXAMPLE 9

An alloy ingot having practically the same chemical composition (22.3% of Nd, 2.0% of Pr, 5.5% of Dy, 1.0% of B, 0.5% of Nb, 0.2% of Al, 2.5% of Co, 0.09% of Ga, 0.1% of Cu, 0.01% of O, 0.004% of C, 0.002% of N and balance of Fe) as that of the alloy strips of Example 5 was produced. To dissipate the a $\alpha$-Fe phase precipitated in the alloy structure, the alloy ingot was subjected to solution heat-treatment at 1100° C. for 6 hours in Ar gas atmosphere. The alloy ingot thus treated was then coarsely pulverized in the same manner as in Example 5 to obtain a starting coarse powder of 32 mesh or less having a chemical composition, by weight, of 22.3% of Nd, 2.0% of Pr, 5.5% of Dy, 1.0% of B, 0.5% of Nb, 0.2% of Al, 2.5% of Co, 0.09% of Ga, 0.1% of Cu, 0.10% of O, 0.02% of C, 0.005% of N and balance of Fe.

A slurry containing the fine powder of an average particle size of 4.7 $\mu$m was prepared in the same manner as in Example 4 except that the starting coarse powder was finely pulverized in the same manner as in Example 5. The slurry was formed into a green body, sintered and heat-treated in the same manner as in Example 4 to produce a rare earth permanent magnet having a chemical composition as shown in Table 2.

The area ratios of grains in the main phase of the rare earth permanent magnet obtained in the same manner as in Example 4 are shown in Table 2.

Further, the magnetic properties and the result of the same corrosion test as in Example 1 are shown in Table 2. As seen from Table 2, the rare earth permanent magnet had magnetic properties nearly equal to those of Example 5 and no change in the Ni-plating was observed even after the passage of 1000 hours.

Comparative Example 7

In the same manner as in Example 6 except that $N_2$ gas was not introduced into the Ar gas atmosphere, a rare earth permanent magnet having a chemical composition as shown in Table 2 was produced. The average particle size of the fine powder was 4.0 $\mu$m.

The area ratios of grains in the main phase of the rare earth permanent magnet obtained in the same manner as in Example 4 are shown in Table 2.

Further, the magnetic properties and the result of the same corrosion test as in Example 1 are shown in Table 2. As seen from Table 2, although the rare earth permanent magnet had magnetic properties nearly equal to those of Example 6, the corrosion resistance was extremely poor because the Ni-plating began to exfoliate only in 192 hours.

Comparative Example 8

An alloy strips of 0.2–0.5 mm thick having a chemical composition, by weight, of 30.0% of Nd, 0.5% of Pr, 1.5% of Dy, 1.05% of B, 0.8% of Nb, 0.2% of Al, 3.0% of Co, 0.08% of Ga, 0.1% of Cu, 0.02% of O, 0.005% of C, 0.005% of N and balance of Fe were produced by a strip-casting method. After being heat-treated at 950° C. for 4 hours in Ar gas atmosphere, the alloy strips were subjected to the same hydrogen-occlusion, dehydrogenation and mechanical pulverization as in Example 4 to obtain a starting coarse powder of 32 mesh or less having a chemical composition, by weight, of 30.0% of Nd, 0.5% of Pr, 1.5% of Dy, 1.05% of B, 0.8% of Nb, 0.2% of Al, 3.0% of Co, 0.08% of Ga, 0.1% of Cu, 0.12% of O, 0.02% of C, 0.009% of N and balance of Fe.

After 100 kg of the starting coarse powder was introduced into a jet mill, the inner atmosphere of the jet mill was replaced with $N_2$ gas while controlling the oxygen content in the $N_2$ gas atmosphere to substantially zero % (0.001 vol. % under an oxygen analyzer). Then, the coarse powder was finely pulverized under a pressure of 7.5 kgf/cm$^2$ while feeding the coarse powder into the jet mill at a rate of 10 kg/hr.

After completion of fine pulverization, the fine powder was recovered from the jet mill directly into a mineral oil (Idemitsu Super Sol PA-30, trade name, manufactured by Idemitsu Kosan Co., Ltd.) in $N_2$ gas atmosphere. The recovered fine powder was made into a slurry having a solid content of 70 weight % by adjusting the amount of the mineral oil. The average particle size of the fine powder was 4.1 $\mu$m.

The slurry was then subjected to wet-compacting in a mold cavity while applying an orientation magnetic field of 14 kOe and a molding pressure of 0.8 ton/cm$^2$. The orientation magnetic field and the molding pressure were applied in the directions perpendicular to each other to form a green body. During the wet-compacting, a portion of mineral oil was discharged from a plurality of holes of the upper punch equipped with the mold cavity through a cloth filter of 1 mm thick.

The green body thus formed was heated in a vacuum furnace at 180° C. for 2 hours under a vacuum degree of $5.0\times10^{-2}$ Torr to remove the residual mineral oil. Then the temperature of the vacuum furnace was raised at a rate of 15° C./min to 1080° C. under a vacuum degree of $3.0\times10^{-4}$ Torr. The temperature was maintained at 1080° C. for 3 hours to complete the sintering of the green body, thereby obtaining a rare earth permanent magnet having a chemical composition as shown in Table 2.

The area ratios of grains in the main phase of the rare earth permanent magnet obtained in the same manner as in Example 4 are shown in Table 2.

The rare earth permanent magnet was further subjected to heat-treatment at 900° C. for 2 hours and at 550° C. for 1 hour, each in Ar gas atmosphere.

The magnetic properties and the result of the same corrosion test as in Example 1 are shown in Table 2. As seen from Table 2, although the rare earth permanent magnet was good in magnetic properties, extremely poor in the corrosion resistance because the Ni-plating began to exfoliate only in 48 hours.

TABLE 2

| | Chemical Composition of Magnet (weight %) | | | | | | | | | | | | |
|---|---|---|---|---|---|---|---|---|---|---|---|---|---|
| No. | Nd | Pr | Dy | B | Fe | Nb | Al | Co | Ga | Cu | N | O | C |
| | | | | | | Examples | | | | | | | |
| 4 | 27.0 | 0.5 | 1.5 | 1.05 | bal. | 0.35 | 0.08 | 2.5 | 0.09 | 0.08 | 0.05 | 0.16 | 0.07 |
| 5 | 22.3 | 2.0 | 5.5 | 1.00 | bal. | 0.50 | 0.20 | 2.0 | 0.09 | 0.10 | 0.04 | 0.14 | 0.06 |
| 6 | 20.7 | 8.6 | 1.2 | 1.05 | bal. | — | 0.08 | 2.0 | 0.09 | 0.10 | 0.07 | 0.18 | 0.07 |
| 7 | 22.0 | 5.0 | 1.5 | 1.10 | bal. | — | 1.00 | 2.5 | — | — | 0.06 | 0.17 | 0.07 |
| 8 | 27.0 | 0.5 | 1.5 | 1.05 | bal. | 0.35 | 0.08 | 2.5 | 0.09 | 0.08 | 0.04 | 0.14 | 0.06 |
| 9 | 22.3 | 2.0 | 5.5 | 1.0 | bal. | 0.50 | 0.20 | 2.0 | 0.09 | 0.10. | 0.03 | 0.12 | 0.06 |
| | | | | | | Comparative Examples | | | | | | | |
| 7 | 20.7 | 8.6 | 1.2 | 1.05 | bal. | — | 0.08 | 2.0 | 0.09 | 0.10 | 0.01 | 0.18 | 0.07 |
| 8 | 30.0 | 0.5 | 1.5 | 1.50 | bal. | — | 0.20 | 3.0 | 0.08 | 0.10 | 0.06 | 0.15 | 0.07 |

| | Magnetic Properties | | | Area Ratio of Grains (%) | | |
|---|---|---|---|---|---|---|
| No. | Br (kG) | iHc (kOe) | (BH)max (MGOe) | ≦10 $\mu$m | ≧13 $\mu$m | Corrosion Resistance |
| | | | | Examples | | |
| 4 | 13.8 | 14.0 | 45.9 | 93 | 4 | No change in Ni-plating after 2500 hrs. |
| 5 | 12.7 | 23.0 | 39.0 | 95 | 3 | No change in Ni-plating after 2500 hrs. |
| 6 | 13.6 | 15.5 | 45.0 | 90 | 5 | No change in Ni-plating after 2500 hrs. |
| 7 | 13.9 | 13.6 | 46.6 | 88 | 7 | No change in Ni-plating after 2000 hrs. |
| 8 | 13.6 | 13.5 | 44.6 | 78 | 12 | No change in Ni-plating after 1200 hrs. Slight exfoliation after 2000 hrs. |
| 9 | 12.7 | 22.5 | 38.8 | 50 | 44 | No change in Ni-plating after 1000 hrs. Partial exfoliation after 2000 hrs. |
| | | | | Comparative Examples | | |
| 7 | 13.6 | 15.7 | 45.0 | 92 | 4 | Exfoliation of Ni-plating after 192 hrs. |
| 8 | 13.2 | 16.5 | 42.1 | 92 | 4 | Exfoliation of Ni-plating after 48 hrs. |

EXAMPLE 10

An alloy strips of 0.1–0.3 mm thick having a chemical composition (alloy A) shown in Table 3 were produced by a strip-casting method in which a mixture containing metal powders of Nd, Pr, B, Ga, Cu and Fe, the purity of each metal powder being 95% or higher, was melt by induction heating in Ar gas atmosphere, and the alloy melt was injected in Ar gas atmosphere onto the peripheral surface of a rotating cooling roll made of copper to form thereon an alloy strip. The alloy strips (alloy A) were heat-treated in a vacuum furnace at 1000° C. for 4 hours under $5\times10^{-2}$ Torr.

Separately, alloy B having a chemical composition shown in Table 3 was cast from the melt obtained by induction-heating in Ar gas atmosphere a mixture containing metal powders, each having a purity of 95% or higher, of Nd, Pr, Dy and Co.

TABLE 3

| | Chemical Composition of Alloy | | | | | | | | | | | |
|---|---|---|---|---|---|---|---|---|---|---|---|---|
| Alloy | Nd | Pr | Dy | B | Nb | Co | Ga | Cu | O | N | C | Fe |
| A | 27.5 | 0.45 | — | 1.17 | — | — | 0.09 | 0.11 | 0.010 | 0.004 | 0.005 | bal. |
| B | 31.5 | 0.50 | 15 | — | — | 20 | — | — | 0.012 | 0.006 | 0.003 | bal. |

Each of the alloy A and alloy B was occluded with hydrogen in an evacuated furnace, heated to 500° C. while evacuating the furnace, cooled to room temperature, and coarsely pulverized to obtain a coarse powder of 32 mesh or less.

A starting powder blend containing 90 weight % of alloy A and 10 weight % of alloy B was prepared by uniformly mixing the coarse powders of alloys A and B in a V-type blender.

After the starting powder blend was introduced into a jet mill, the inner atmosphere of the jet mill was replaced with $N_2$ gas while controlling the oxygen content in the $N_2$ gas atmosphere to substantially zero % (0.001 vol. % under an oxygen analyzer). Then, the starting powder blend was finely pulverized under a pressure of 7.0 kgf/cm$^2$ while feeding the powder blend into the jet mill at a rate of 10 kg/hr.

After completion of fine pulverization, the fine powder was recovered from the jet mill directly into a mineral oil (Idemitsu Super Sol PA-30, trade name, manufactured by Idemitsu Kosan Co., Ltd.) under $N_2$ gas atmosphere. The recovered fine powder was made into a slurry having a solid content of 78 weight % by adjusting the amount of the mineral oil. The average particle size of the fine powder was 4.5 $\mu$m.

The slurry was then subjected to wet-compacting in a mold cavity while applying an orientation magnetic field of 12 kOe and a molding pressure of 0.8 ton/cm$^2$. The orientation magnetic field and the molding pressure were applied in the directions perpendicular to each other to form a green body. During the wet-compacting, a portion of mineral oil was discharged from a plurality of holes of the upper punch equipped with the mold cavity through a cloth filter of 1 mm thick.

The green body thus formed was heated in a vacuum furnace at 200° C. for one hour under a vacuum degree of $5.0\times10^{-2}$ Torr to remove the residual mineral oil. Then the temperature of the vacuum furnace was raised at a rate of 15° C./min to 1070° C. under a vacuum degree of $5\times10^{-5}$ Torr. The temperature was maintained at 1070° C. for 2 hours to complete the sintering of the green body.

The sintered product was further subjected to heat-treatment at 900° C. for 2 hours and at 500° C. for 1 hour, each in Ar gas atmosphere to obtain a rare earth permanent magnet having a chemical composition as shown in Table 4.

The magnetic properties after machining and the corrosion resistance evaluated in the same manner as in Example 1 are shown in Table 5. As seen from Table 5, the rare earth permanent magnet had good magnetic properties. From comparison of magnetic properties of Example 10 with those of Example 11 described below, it can be seen that the starting powder is preferred to be a powder blend of different alloys because the magnetic properties were further improved. Further, as seen from the result of corrosion test, the rare earth permanent magnet produced above showed a good corrosion resistance.

Comparative Example 9

The same powder blend (alloy A: alloy B=90:10 by weight) as used in Example 10 was finely pulverized in the same manner as in Example 10 except that the fine powder was recovered from the jet mill into an empty container without using a solvent. In such a dry recovery, since the fine powder likely to ignite upon contacting with air when the oxygen content in the inner atmosphere of jet mill is too low, the fine pulverization was conducted while supplying oxygen gas to maintain the oxygen content in $N_2$ gas atmosphere to 0.1 vol. %. The average particle size of the dry fine powder thus prepared was 4.5 $\mu$m.

The dry fine powder was then subjected to dry-compacting in a mold cavity while applying an orientation magnetic field of 12 kOe and a molding pressure of 0.8 ton/cm$^2$. The orientation magnetic field and the molding pressure were applied in the directions perpendicular to each other.

The green body thus formed was sintered by kept at 1070° C. for 2 hours under $5.0\times10^{-5}$ Torr, and then subjected to two-stage heat treatment in the same manner as in Example 10 to produce a rare earth permanent magnet having a chemical composition as shown in Table 4. The chemical composition of the rare earth permanent magnet thus produced was nearly equal to that of Example 10 except for the oxygen content (0.612%) and the carbon content (0.045%).

As shown in Table 5, the rare earth permanent magnet was inferior in magnetic properties (Br, iHc and (BH)max) as compared with Example 10. The reason for such deterioration in magnetic properties may be regarded as follows. The fine powder was oxidized during the dry recovery, and as a result thereof, a liquid phase cannot be produced in a sufficient amount for sintering. The lack of the liquid phase during the sintering process causes a low density of sintered product, this failing to provide a sintered magnet with good magnetic properties. Thus, although a powder blend was used as the starting material, high magnetic properties were not attained because the fine powder was dry-recovered and dry-compacted. On the other hand, in Example 10, the fine powder prepared under an atmosphere of a low oxygen content was recovered in the form of slurry and wet-compacted to form a green body. Thus, it can be seen that a rare earth permanent magnet having high magnetic properties can be obtained by the method of the present invention which includes the wet-recovery of the fine powder and the wet-compacting of the slurry.

EXAMPLE 11

A rare earth permanent magnet having nearly the same chemical composition as that of Example 10 was produced from a starting powder of single alloy as follows.

A mixture of metal powders, each having a purity of 95% or higher, of Nd, Pr, Dy, B, Co, Ga, Cu and Fe were strip-cast under the same conditions as in Example 10 to prepare alloy strips having a chemical composition, by weight, of 27.9% of Nd, 0.46% of Pr, 1.5% of Dy, 1.05% of B, 2.0% of Co, 0.08% of Ga, 0.10% of Cu, 0.2% of O, 0.005% of C, 0.003% of N and balance of Fe.

Following the same procedure as in Example 10, a rare earth permanent magnet having a chemical composition as shown in Table 4 was produced. The chemical composition of the rare earth permanent magnet thus produced was nearly equal to that of Comparative Example 9 except for the oxygen content of 0.170% and the carbon content of 0.063%.

As shown in Table 5, the rare earth permanent magnet was sufficiently good in both magnetic properties and corrosion resistance.

TABLE 4

| | Chemical Composition of Magnet (weight %) | | | | | | | | | | | |
|---|---|---|---|---|---|---|---|---|---|---|---|---|
| No. | Nd | Pr | Dy | B | Nb | Co | Ga | Cu | O | C | N | Fe |
| Examples | | | | | | | | | | | | |
| 10 | 27.9 | 0.46 | 1.5 | 1.05 | — | 2.0 | 0.08 | 0.10 | 0.096 | 0.063 | 0.067 | bal. |
| 11 | 27.9 | 0.46 | 1.5 | 1.05 | — | 2.0 | 0.08 | 0.10 | 0.170 | 0.063 | 0.065 | bal. |
| Comparative Example | | | | | | | | | | | | |
| 9 | 27.9 | 0.46 | 1.5 | 1.05 | — | 2.0 | 0.08 | 0.10 | 0.612 | 0.045 | 0.065 | bal. |

TABLE 5

| | Production Method | | Magnetic Properties | | | | |
|---|---|---|---|---|---|---|---|
| No. | Starting Material | Compacting | Br (kG) | iHc (kOe) | (BH)max (MGOe) | Density (g/cc) | Corrosion Resistance |
| Examples | | | | | | | |
| 10 | blend | wet | 14.1 | 16.3 | 47.5 | 7.60 | No change after 2500 hrs. |
| 11 | single | wet | 13.9 | 15.0 | 46.0 | 7.58 | No change after 2500 hrs. |
| Comparative Example | | | | | | | |
| 9 | blend | dry | 13.5 | 11.5 | 43.3 | 7.42 | No change after 2500 hrs. |

EXAMPLE 12

In the same manner as in Example 10, a slurry containing a fine powder having an average particle size of 4.1 $\mu$m was prepared from a starting powder blend consisting of 85 weight % of alloy C and 15 weight % of alloy D, each having a chemical composition shown in Table 6.

TABLE 6

| | Chemical Composition of Alloy | | | | | | | | | | | |
|---|---|---|---|---|---|---|---|---|---|---|---|---|
| Alloy | Nd | Pr | Dy | B | Nb | Co | Ga | Cu | O | N | C | Fe |
| C | 27.0 | 0.40 | — | 1.18 | — | — | 0.10 | 0.12 | 0.011 | 0.004 | 0.004 | bal. |
| D | 5.5 | 0.59 | 40 | — | — | 20 | — | — | 0.013 | 0.006 | 0.003 | bal. |

The slurry was wet-compacted in the same as in Example 10 to form a green body. After heated in a vacuum furnace at 200° C. for one hour under a vacuum degree of $5.0\times10^{-2}$ Torr to remove the residual mineral oil, the green body was heated to 1080° C. at a rate of 15° C./min and sintered at 1080° C. for 2 hours under a vacuum degree of $5.0\times10^{-5}$ Torr. The sintered product was further subjected to heat-treatment at 900° C. for 2 hours and at 480° C. for 1 hour, each in Ar gas atmosphere to obtain a rare earth permanent magnet having a chemical composition as shown in Table 7.

The magnetic properties after machining and the corrosion resistance evaluated in the same manner as in Example 1 are shown in Table 8. As seen from Table 8, the rare earth permanent magnet had good magnetic properties. From comparison of magnetic properties of Example 12 with those of Example 13 described below, it can be seen that the starting powder is preferred to be a powder blend of different alloys because the magnetic properties were further improved. Further, as seen from the result of corrosion test, the rare earth permanent magnet produced above showed a good corrosion resistance.

Comparative Example 10

The same powder blend as used in Example 12 was treated in the same manner as in Comparative Example 9 to obtain a fine powder having an average particle size of 4.1 μm. The fine powder was dry-compacted and sintered in the same manner as in Comparative Example 9 except for sintered at 1080° C. The sintered product was subjected to the same heat treatment as in Example 12 to produce a rare earth permanent magnet having a chemical composition shown in Table 7, which chemical composition was nearly equal to that of Example 12 except for the oxygen content and the carbon content.

The magnetic properties after machining and the corrosion resistance evaluated in the same manner as in Example 1 are shown in Table 8. From the same reason as mentioned in Comparative Example 9, the rare earth permanent magnet was quite inferior in magnetic properties (Br, iHc and (BH)max) as compared with Example 12.

EXAMPLE 13

A rare earth permanent magnet having nearly the same chemical composition as that of Example 12 was produced from a starting powder of single alloy as follows.

A mixture of metal powders, each having a purity of 95% or higher, of Nd, Pr, Dy, B, Co, Ga, Cu and Fe were strip-cast under the same conditions as in Example 12 to prepare alloy strips having a chemical composition, by weight, of 23.8% of Nd, 0.42% of Pr, 6.0% of Dy, 1.00% of B, 3.0% of Co, 0.09% of Ga, 0.09% of Cu, 0.18% of O, 0.006% of C, 0.002% of N and balance of Fe.

Following the same procedure as in Example 12, a rare earth permanent magnet having a chemical composition as shown in Table 7 was produced. The chemical composition of the rare earth permanent magnet thus produced was nearly equal to that of Example 12 except for the oxygen content of 0.182%.

As shown in Table 8, the rare earth permanent magnet was sufficiently good in both magnetic properties and corrosion resistance.

TABLE 7

| | Chemical Composition of Magnet (weight %) | | | | | | | | | | | |
|---|---|---|---|---|---|---|---|---|---|---|---|---|
| No. | Nd | Pr | Dy | B | Nb | Co | Ga | Cu | O | C | N | Fe |
| Examples | | | | | | | | | | | | |
| 12 | 23.8 | 0.42 | 6.0 | 1.00 | — | 3.0 | 0.09 | 0.09 | 0.094 | 0.064 | 0.066 | bal. |
| 13 | 23.8 | 0.42 | 6.0 | 1.00 | — | 3.9 | 0.09 | 0.09 | 0.182 | 0.065 | 0.064 | bal. |
| Comparative Example | | | | | | | | | | | | |
| 10 | 23.8 | 0.42 | 6.0 | 1.00 | — | 3.0 | 0.09 | 0.09 | 0.612 | 0.047 | 0.064 | bal. |

TABLE 8

| | Production Method | | Magnetic Properties | | | | |
|---|---|---|---|---|---|---|---|
| No. | Starting Material | Compacting | Br (kG) | iHc (kOe) | (BH)max (MGOe) | Density (g/cc) | Corrosion Resistance |
| Examples | | | | | | | |
| 12 | blend | wet | 12.6 | 26.2 | 37.7 | 7.60 | No change after 2500 hrs. |
| 13 | single | wet | 12.4 | 25.0 | 36.5 | 7.57 | No change after 2500 hrs. |
| Comparative Example | | | | | | | |
| 10 | blend | dry | 12.1 | 24.1 | 34.9 | 7.47 | No change after 2500 hrs. |

What is claimed is:

1. A method for producing a rare earth permanent magnet, comprising the steps of:

strip-casting a melt of a first alloy into a first alloy strip having a thickness of 1 mm or less;

heat-treating said first alloy strip at 800–1100° C. in an inert gas atmosphere or in vacuo; and pulverizing said heat-treated first alloy strip into a coarse powder of said first alloy, mixing said coarse powder of said first alloy and a coarse powder of a second alloy in a weight ratio of 70–99:1–30, said first alloy having a chemical composition, by weight, of 26.7–31% of R wherein R is at least one rare earth element including yttrium, 0.9–2.0% of B, 0.1–3.0% of M wherein M is at least one of Ga, Al and Cu and balance of Fe, and including a $R_2Fe_{14}B$ phase, and said second alloy having a chemical composition, by weight, of 35–70% of R, 5–50% of Co, 0.1–30 % of M and balance of Fe;

pulverizing the mixture of said coarse powder into a fine powder;

recovering the fine powder in a solvent in an inert gas atmosphere in the form of a slurry;

wet-compacting said slurry to form a green body while applying at least one magnetic field; and sintering said green body in a vacuum furnace.

2. The method according to claim 1, wherein said pulverization of said heat-treated alloy strip is carried out by spontaneously degrading said alloy by hydrogen occlusion and subsequently dehydrogenating said degraded alloy.

3. The method according to claim 1, wherein said slurry is wet-compacted by compression molding.

4. The method according to claim 1, wherein said solvent for said slurry is selected from the group consisting of mineral oils, synthetic oils and vegetable oils, each having a flash point of 70° C. or higher and less then 200° C. under 1 atm, a fractionating point of 400° C. or less and a kinematic viscosity of 10 cSt or less at ordinary temperature.

* * * * *